US007883173B1

(12) United States Patent
Tratar et al.

(10) Patent No.: US 7,883,173 B1
(45) Date of Patent: Feb. 8, 2011

(54) HEIGHT-ADJUSTABLE PRINTING SYSTEM WITH SINGLE-USE INKJET CARTRIDGE

(75) Inventors: David B. Tratar, Dearborn, MI (US); Johan P. Bakker, Livingston, MI (US)

(73) Assignee: Burroughs Payment Systems, Inc., Plymouth, MI (US)

( * ) Notice: Subject to any disclaimer, the term of this patent is extended or adjusted under 35 U.S.C. 154(b) by 726 days.

(21) Appl. No.: 11/903,989

(22) Filed: Sep. 25, 2007

(51) Int. Cl.
*B41J 2/165* (2006.01)
*B41J 25/308* (2006.01)

(52) U.S. Cl. ..... 347/22; 347/20; 347/8

(58) Field of Classification Search ..... 347/29, 347/32, 20, 22, 8
See application file for complete search history.

(56) References Cited

U.S. PATENT DOCUMENTS 5,363,132 A * 11/1994 Ikkatai ..... 347/8
5,880,747 A * 3/1999 Bartenwerfer et al. ..... 347/4
6,015,211 A * 1/2000 Kinoshita et al. ..... 347/109
7,221,473 B2 * 5/2007 Jeran et al. ..... 358/1.16
7,665,837 B2 * 2/2010 Son ..... 347/104

* cited by examiner

*Primary Examiner*—Julian D Huffman
*Assistant Examiner*—Jason S Uhlenhake
(74) *Attorney, Agent, or Firm*—Honigman Miller Schwartz and Cohn LLP

(57) ABSTRACT

An automated document processing system including a printing system is disclosed. The printing system includes a carriage mountable adjacent to a path of travel of a printable surface. The system also includes a print cartridge housing configured to hold a print cartridge having a printing aperture oriented toward the path of travel of the printable surface. The print cartridge housing is mounted to the chassis and moveable in a direction normal to the path of travel of the printable surface. The system further includes a clean and park station pivotally mounted to the chassis and capable of pivoting across the printing aperture of the print cartridge to wipe and cover the printing aperture. In the system disclosed, the print cartridge housing and the clean and park station are moveable between a printing position and a parked position.

23 Claims, 7 Drawing Sheets

HEIGHT-ADJUSTABLE PRINTING SYSTEM WITH SINGLE-USE INKJET CARTRIDGE

CROSS REFERENCE TO RELATED APPLICATIONS

The present disclosure is related to U.S. patent application Ser. No. 11/903,945 filed on Sep. 25, 2007 and entitled "Printing System With Single-Use Inkjet Cartridge", the disclosure of which is hereby incorporated by reference.

TECHNICAL FIELD

The present disclosure relates generally to printing devices. In particular, the present disclosure relates to incorporating a single-use inkjet cartridge into a printing system.

BACKGROUND

Typical inkjet printers, using single use disposable inkjet printer cartridges, are characterized in that a piece of paper or other printable surface is fed into a printer to incremental, stationary positions. The printing system then moves a print head across the lateral length of the paper while the paper is held in place, creating a line of printed characters. When these inkjet printers have completed printing a document, the print head slides across a wiper blade positioned beyond an edge of the paper and into a "parked" position. Sliding the print head across the wiper cleans the print head, and "parking" the cartridge caps it and prevents leaking ink from the inkjet cartridge.

In automated document processing systems, a print head is held stationary during printing, and the printed surface is moved across a printing aperture to allow the printer to direct ink onto the printable surface. One example of such systems includes a check printing system in which specific check processing information, such as an endorsement, may be printed onto a portion of the check to expedite routing and processing of the check. In such systems, banking laws may require that the entity performing the processing of the document can print a unique, programmable endorsement onto the front or rear of the check.

Existing print heads in such systems incorporate complex circuitry and mechanical systems to deliver ink to the print head, and require complicated ink piping and delivery systems. Additionally, complex electrical systems are required to control the ink flow.

Although a disposable inkjet printer cartridge may be used in place of such complicated print heads, automated document processing systems generally retain the print head in a constant position. These systems, unlike traditional inkjet printers, are not configured to move the print head across a wiper and into a capped position. This leaves the inkjet cartridge prone to clogging and drying out, causing failure of the document processing system. Furthermore, such systems are not configured to change the vertical position on a document at which the print head can print. This limits the printable space available on a check or other document passing through the system.

For at least this reason, improvements are desirable.

SUMMARY

In accordance with the following disclosure, the above and other problems are solved by the following:

In a first aspect, a printing system is disclosed. The printing system includes a carriage mountable adjacent to a path of travel of a printable surface. The system also includes a print cartridge housing configured to hold a print cartridge having a printing aperture oriented toward the path of travel of the printable surface. The print cartridge housing is mounted to the chassis and moveable in a direction normal to the path of travel of the printable surface. The system further includes a clean and park station pivotally mounted to the chassis and capable of pivoting across the printing aperture of the print cartridge to wipe and cover the printing aperture. In the system disclosed, the print cartridge housing and the clean and park station are moveable between a printing position and a parked position.

In a second aspect, a method of operating a printing system is disclosed. The method includes providing a print cartridge housing mounted to a carriage, the print cartridge housing configured to hold a print cartridge in a stationary printing position when printing onto a moving printable surface. The method further includes retracting a print cartridge housing from the printing position in a direction normal to a path of travel of a printable surface. The method also includes pivoting a clean and park station to a parked position across a printing aperture of a print cartridge held in the print cartridge housing to wipe the printing aperture and align a cap with the printing aperture.

In a third aspect, a check printing system is disclosed. The check printing system includes a carriage mountable adjacent to a path of travel of a check. The system further includes a print cartridge housing configured to hold a disposable inkjet print cartridge having a printing aperture oriented toward the path of travel of the check. The print cartridge housing is mounted to the chassis and moveable in a direction normal to the path of travel of the printable surface. The system also includes a height adjustment mechanism configured to locate the print cartridge housing at a plurality of user-selectable heights along the path of travel. The system includes a clean and park station including a wiper and a cap, where the clean and park station pivotally mounted to the chassis and capable of pivoting across the printing aperture of the disposable inkjet print cartridge to wipe and cover the printing aperture. The system also includes a motor configured to drive the print cartridge housing and the clean and park station between a printing position and a parked position.

In a fourth aspect, an automated document processing system is disclosed. The automated document processing system includes a document feeder and a document sorter connected to the document feeder by a path of travel. The automated document processing system also includes a printing system. The printing system includes a carriage mountable adjacent to a path of travel of a printable surface. The system also includes a print cartridge housing configured to hold a print cartridge having a printing aperture oriented toward the path of travel of the printable surface. The print cartridge housing is mounted to the chassis and moveable in a direction normal to the path of travel of the printable surface. The system further includes a clean and park station pivotally mounted to the chassis and capable of pivoting across the printing aperture of the print cartridge to wipe and cover the printing aperture. In the system disclosed, the print cartridge housing and the clean and park station are moveable between a printing position and a parked position.

DETAILED DESCRIPTION

Figure 1:
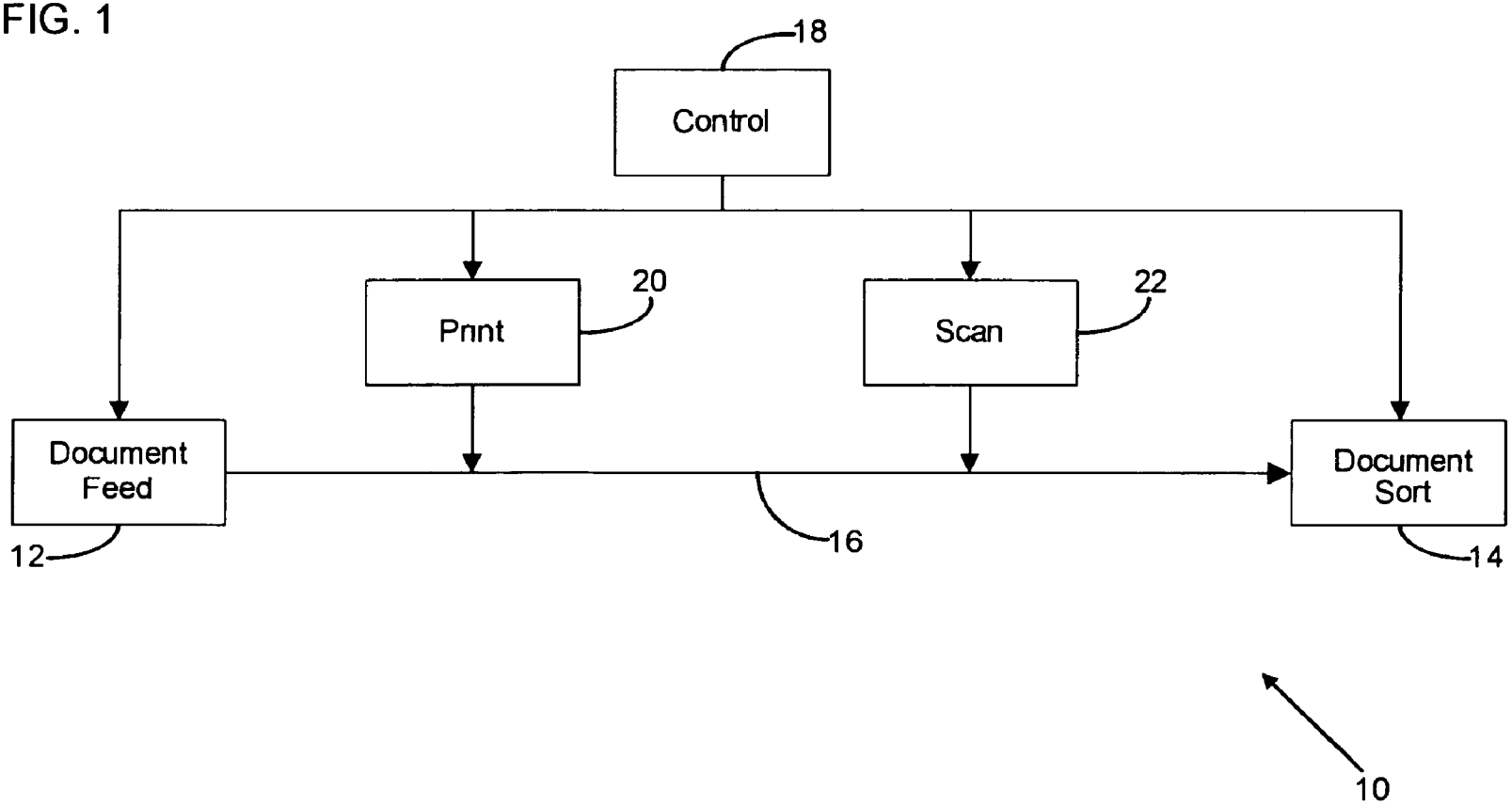
FIG. 1 is a schematic block diagram of an automated document processing system according to an embodiment of the present disclosure.

Various embodiments of the present disclosure will be described in detail with reference to the drawings, wherein like reference numerals represent like parts and assemblies throughout the several views. Reference to various embodiments does not limit the scope of the invention, which is limited only by the scope of the claims attached hereto. Additionally, any examples set forth in this specification are not intended to be limiting and merely set forth some of the many possible embodiments for the claimed invention.

In general, the present disclosure relates to incorporating a single-use inkjet cartridge into a print assembly of an automated document processing system. The automated document processing system of the present disclosure allows height adjustable printing (i.e. multiple printed lines of text) on one or more moving printable objects from a stationary printing device. By automated document processing system, it is intended that any of a number of types of document processing systems are incorporated which include moving-document printing systems, in which a stationary printing device (and related print assembly) prints characters in a line onto moving printable media (e.g. paper, such as checks or other endorseable documents) passing by a print aperture at a high rate of speed. In the systems disclosed herein, a low-cost solution for printing is disclosed using a disposable inkjet print cartridge integrated into a print assembly capable of self-cleaning and maintenance.

Referring now to FIG. 1, an automated document processing system 10 is shown in accordance with a possible embodiment of the present disclosure. The automated document processing system 10 is generally configured to process documents, such as checks, in a high-volume system in which user supervision is minimized. In one embodiment, the automated document processing system 10 is a check processing system used to print and scan checks at a financial institution or document processing company. The automated document processing system 10 includes a document feeder 12 interconnected with a document sorter along a path of travel 16 of documents. The document feeder 12 is generally a document take-up mechanism provided with a large number of documents that are required to be processed. The document sorter 14 is an endpoint at which the documents have been processed, and can include one or more sorting mechanisms configured to arrange physical documents in a desired manner. The path of travel 16 may be defined by any of a number of document movement and/or guiding mechanisms, such as rollers, guides, or other systems able to grip and move documents from the feeder 12 to the sorter 14.

A control system 18 is interconnected to the document feeder 12 and the document sorter 14 to control flow of documents along the path of travel 16. The control system 18 can be an application level program configured to control flow and processing of documents. The control system 18 can reside on a general purpose or specific purpose computing system capable of communicating with the feeder 12 and sorter 14.

The control system 18 further directs a printing system 20 and a scanning system 22. The printing system 20 prints desired characters and/or images onto documents passing by the printing system along the path of travel 16. The printing system 20 can incorporate a print assembly which is configured to print from a stationary printing aperture onto moving documents passing by the printing system along the path of travel. In the example of a check processing system, the printing system 20 can print an endorsement onto the back of a check which is being processed at a financial institution operating the system 10. Other documents may be processed as well, by financial institutions or other document processing entities. The scanning system 22 can scan one or both sides of documents passing along the path of travel 16, to store text and/or images displayed on the documents.

By passing documents through the automated document processing system 10, a large volume of documents can be printed and electronically captured, such that various records can be stored for each of a large number of documents. In the case of a financial institution processing checks or other documents, that institution can endorse a large number of checks, can capture check images and routing information, and can appropriately sort the document for distribution back to the issuing institution of the check.

Figure 2:
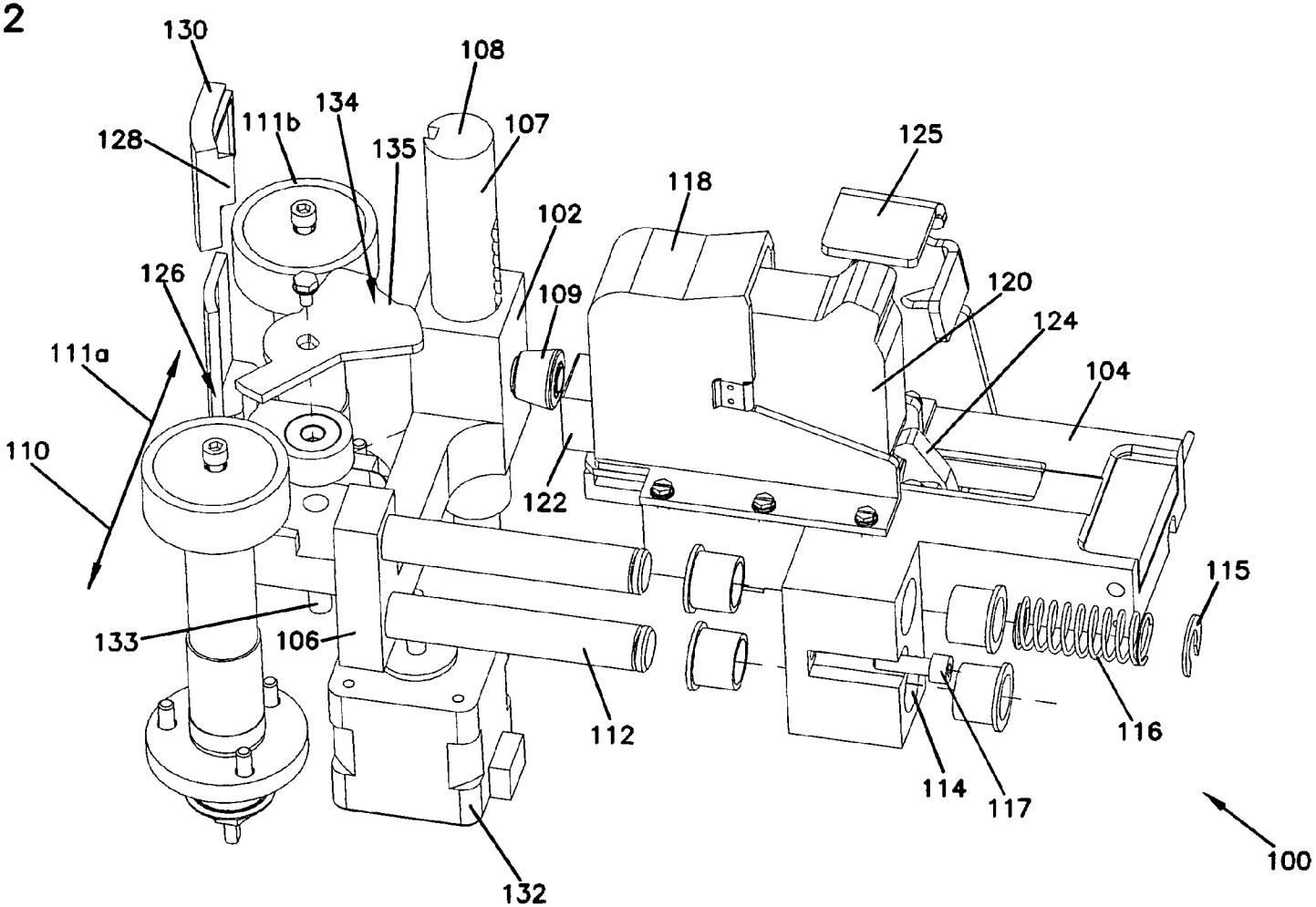
FIG. 2 is a perspective view of a print assembly according to a possible embodiment of the present disclosure.
Figure 3:
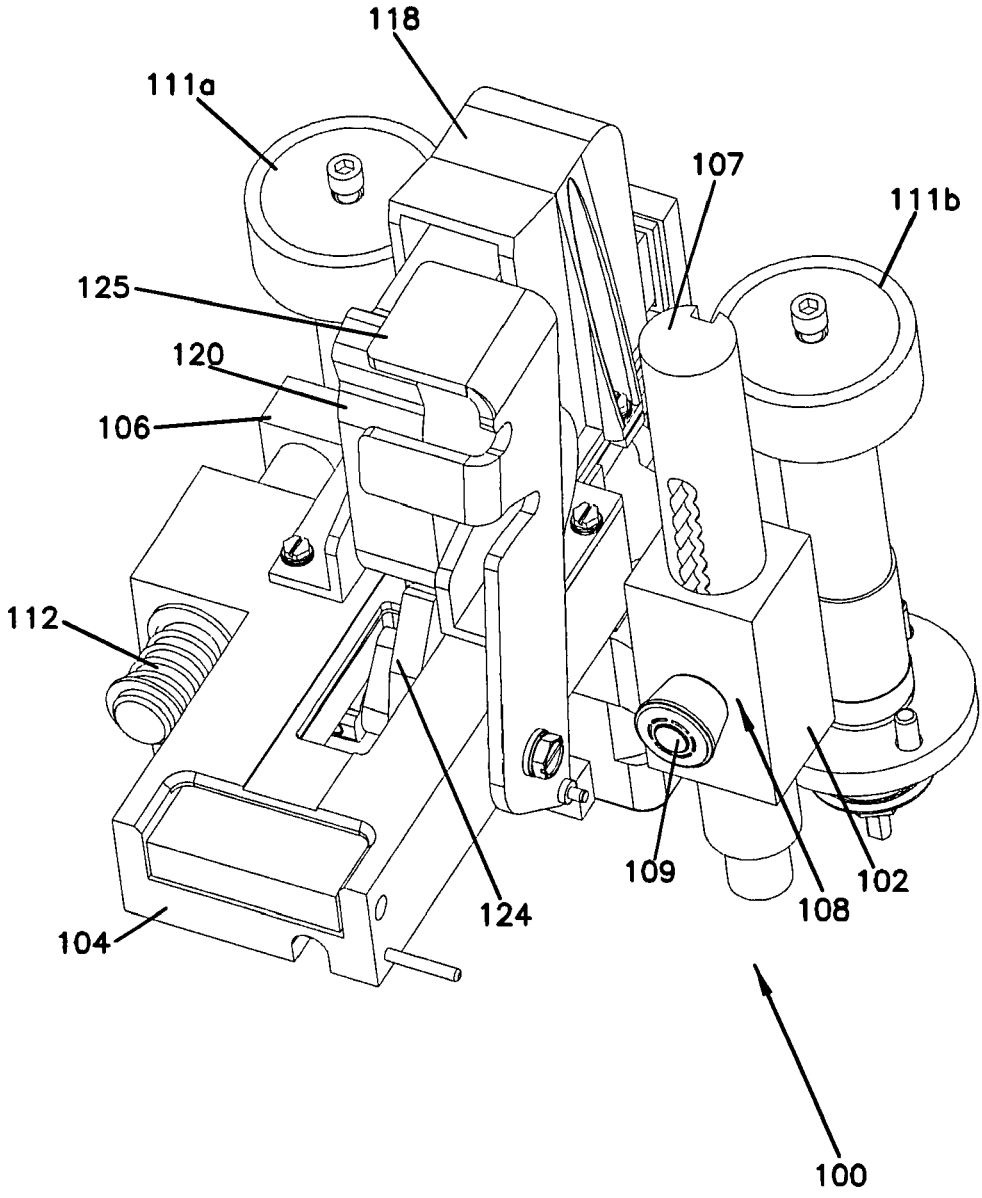
FIG. 3 is an assembled rear perspective view of the print assembly of FIG. 2.

Referring now to FIGS. 2-3, a printing system 100 is shown according to a possible embodiment of the present disclosure. The printing system 100 is generally arranged to provide features supporting use of a disposable inkjet print cartridge in a printing system having a stationary printing location. The system 100 is moveable between a printing position and a parked position, as described in greater detail below. In certain embodiments, the system 100 corresponds to the printing system 20 of FIG. 1, and can be incorporated into an automated document processing system.

The system 100 includes a frame 102 and a carriage 104. The frame 102 provides a stationary base for connection of the various components of the system, and includes a carriage mount 106 and a height adjustment mechanism 108. The carriage mount 106 allows the carriage 104 to be mounted to the stationary frame 102, near a path of travel 110 (defined by the locations of rollers 111*a-b*) of documents or other printable surfaces past the system 100. The path of travel 110 generally corresponds to a portion of the path of travel 16 of FIG. 1. In the embodiment shown, the carriage mount 106 includes a pair of rods 112 extending in a direction normal to the path of travel 110 of printed documents past the system 100. The rods 112 receive openings 114 in the carriage 104, and operate in conjunction with one or more compression springs 116 inserted into the openings 114 and maintained by a fastener, shown as the ring 115 of FIG. 2, to flexibly spring-bias the carriage 104 toward the path of travel of printable surfaces passing by the system 100.

The carriage 104 incorporates a print cartridge housing 118, which is configured to secure a print cartridge 120 within it. The print cartridge 120, when inserted into the housing 118, is oriented such that a printing aperture 122 is directed toward the path of travel 110 of printable surfaces passing by the system 100. The carriage 104 includes a cartridge retention tab 124 and a retention arm 125, configured to assist in retaining the print cartridge 120 within the housing 118. The carriage 104, when connected to the frame 102, directs the printing aperture 122 of the print cartridge 120 toward the path of travel 110 of checks or other documents.

The height adjustment mechanism 108 includes a pole 107 and a height adjustment knob 109. The pole 107 includes a plurality of openings spaced apart at varying heights. The knob 109 includes a spring-biased pin (not shown) which can be inserted into one of the openings to set the height of the frame 102. To set the printing height of the system 100, a user can pull the knob 109 to release the frame 102 from the pole 107 such that it can slide vertically along the pole. The user can then release the knob 109 at a desired location such that the spring loaded pin inserts into one of the openings. By setting the height of the frame 102 at differing heights, the system 100 can locate the printing aperture 122 of the print cartridge 120 at differing vertical locations on documents passing along the path of travel 110. Therefore, multiple lines of text can be printed onto each document.

Optionally, a print distance control 117 is incorporated into the carriage 104, and provides a second axis of printing adjustment for the system 100. The print distance control 117, shown as a position screw, adjusts the distance between the printing aperture 122 and the path of travel 110 when the system 100 is in a printing position. By adjusting the print distance control 117, a user can manually focus the images printed on the documents passing along the path of travel by controlling the distance from the aperture 122 to a document.

A clean and park assembly 126 is mounted to the frame 102 as well. The clean and park assembly 126 is configured to pivot across the printing aperture 122 when the system 100 is not in use. The clean and park assembly 126 includes a wiper 128 and a cap 130 located on a surface of the assembly 126 that faces aperture 122 when pivoted across it. The wiper 128 is a rubber or plastic extension configured to uniformly pass across the printing aperture 122, to clean any extraneous ink from the printing aperture and thereby preventing streaking or smudging from occurring during printing. The cap 130 provides a sealing structure which can form an airtight seal over the printing aperture 122, preventing ink from drying out in the printing aperture and thereby causing a printer failure. The clean and park assembly 126 and the carriage 104 are moved between a printing position during operation, and a "parked" position when not in use. Details of the movement of the assembly 126 and carriage 104 are described below in detail, particularly in conjunction with FIGS. 5-7.

A motor 132 mounted to the frame 102 resides axially to a cam plate 134 and the clean and park assembly 126. In one embodiment, the motor 132 is a stepper motor; however, other types of motors can be used in conjunction with the present disclosure. If other types of motors are used but discrete positioning of the cam plate is desired, a stepped drive mechanism or limiting mechanism can be incorporated into the system as well.

The motor 132 drives rotation of the cam plate 134 using a cam plate mounting shaft 133. The cam plate is shaped to, when rotated, pivot the clean and park assembly 126 between a "printing" position (as shown, for example, in FIG. 7, below), and a "parked" position (as shown, for example, in FIG. 5, below). In the printing position, the assembly 126 is pivoted away from the printing aperture 122 of the print cartridge 120, such that the print cartridge extends closer to the path of travel 110 than the assembly. In the parked position, the assembly 126 is pivoted across the printing aperture 122, causing the cap 130 to block the aperture 122. While changing between the printing and parked positions, the wiper 128 wipes across the aperture 122, removing excess ink (as shown in FIG. 6), thereby preventing streaking during the printing operation.

The cam plate 134 is further shaped to press against a portion of the carriage 104, such as against a roller 105 fixedly attached to the carriage 104, when rotated by the motor 132. The force of the cam plate 134 counteracts the force of the compression spring 116 and moves the carriage 104 and attached print cartridge housing 118 in a direction normal to the path of travel 110 of documents passing by the system 100. A notch 135 in the cam plate 134 passes through the roller 105 of the carriage 104 when the clean and park assembly passes in front of the printing aperture 122. This allows the compression springs 116 to move the carriage forward toward the path of travel 110. When the carriage 104 moves toward the path of travel 110 due to the notch 135, the printing aperture 122 moves toward the wiper 128 which concurrently passes in front of the aperture, thereby cleaning the printing aperture uniformly. After the notch 135 in the cam plate 134 is passed, the cam plate 134 continues pressing the roller 105, separating the carriage 104 from the frame 102 until the extended portion of the cam plate including the notch 135 is rotated away from the carriage. At this point, the cam plate has rotated the clean and park assembly 126 to a fully parked position. The cam plate 134 allows the carriage 104 to be pressed by the compression springs 116 toward the clean and park assembly 126, sealing the printing aperture 122 against the cap 130. By sealing the printing aperture 122, drying of any remaining ink on the aperture is avoided.

Figure 4:
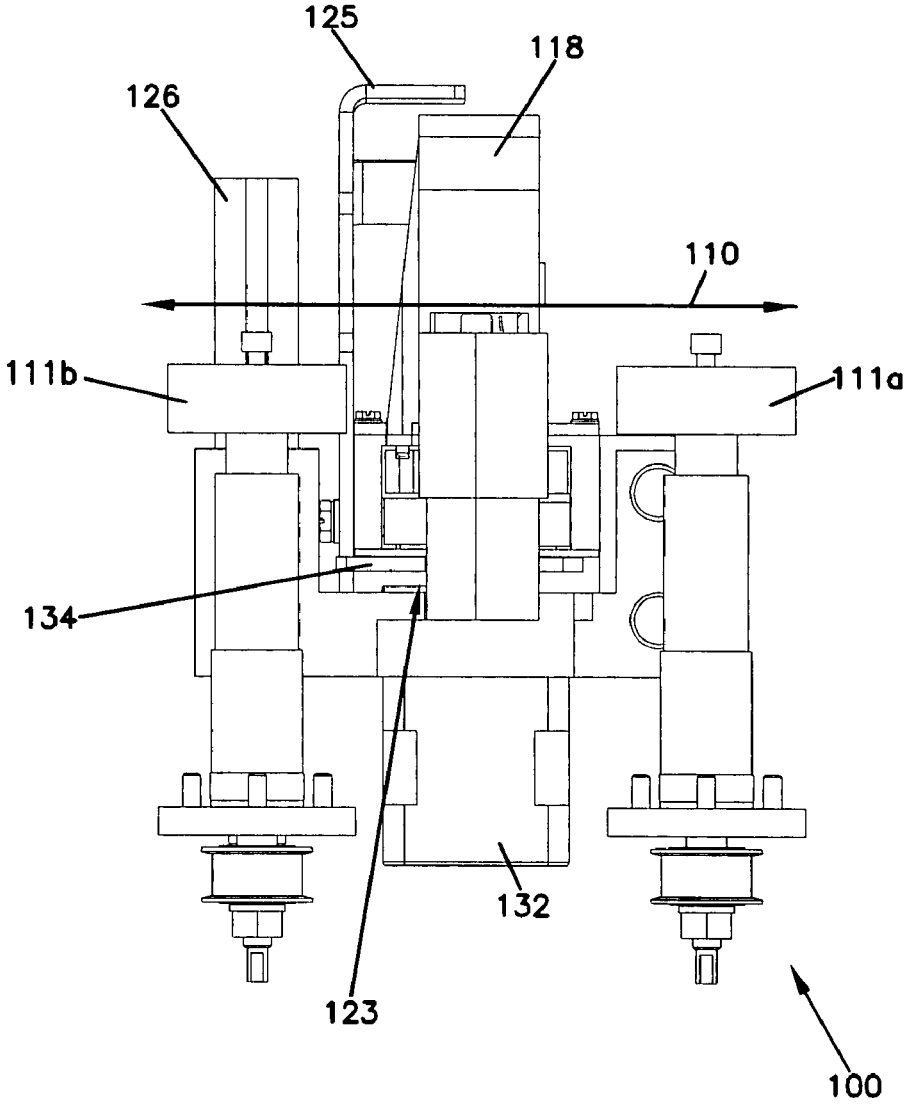
FIG. 4 is a side elevational view of the print assembly of FIG. 2.

Referring now to FIG. 4, a side elevational view of the printing system 100 is shown. As shown, the printing aperture 122 is oriented toward the path of travel 110 above a location at which rollers 111*a-b* contact the printable surfaces passing by the system 100. The cam plate 134 resides at a height allowing it to contact the carriage 104 and the clean and park assembly 126 concurrently, thereby coordinating movement of those two moveable components. An optional movement limiter 123 may be integrated into the clean and park assembly, to ensure that the assembly aligns with the printing aperture 122 when in the parked position.

The height adjustment mechanism 108 allows the frame 102, carriage 104, and other components to be lifted from the position shown in FIG. 3 to any of a number of user-selectable positions defined by the holes in the pole 107. It is noted that the lowermost position of the frame 102 and carriage 104 retains the printing aperture 122 above the topmost guide portions of the rollers 111*a-b*, thereby preventing ink deposited on documents from being smeared or streaked by the rollers 111*a-b*.

Figure 5:
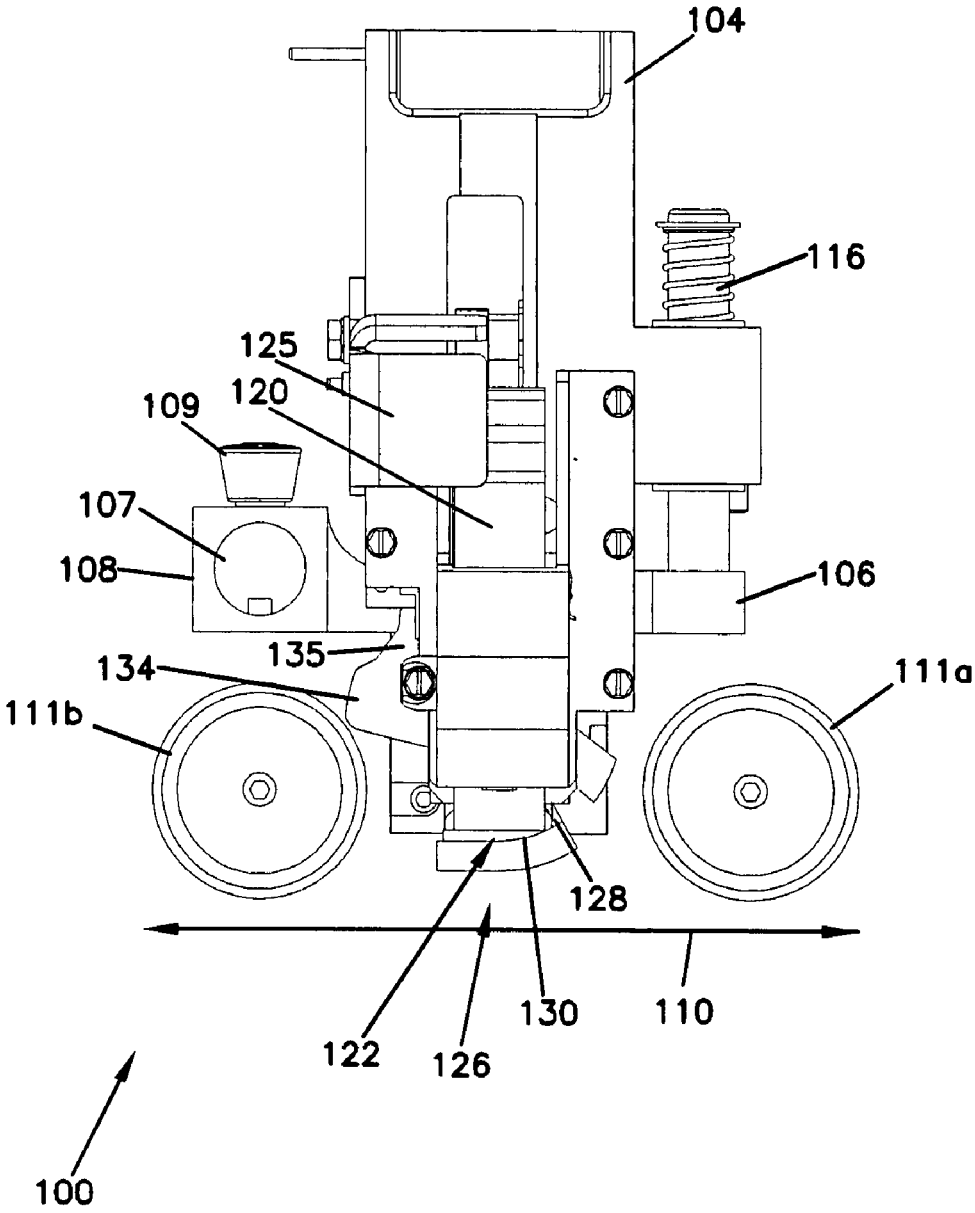
FIG. 5 is a top plan view of the print assembly of FIG. 2 in a "parked" position.
Figure 6:
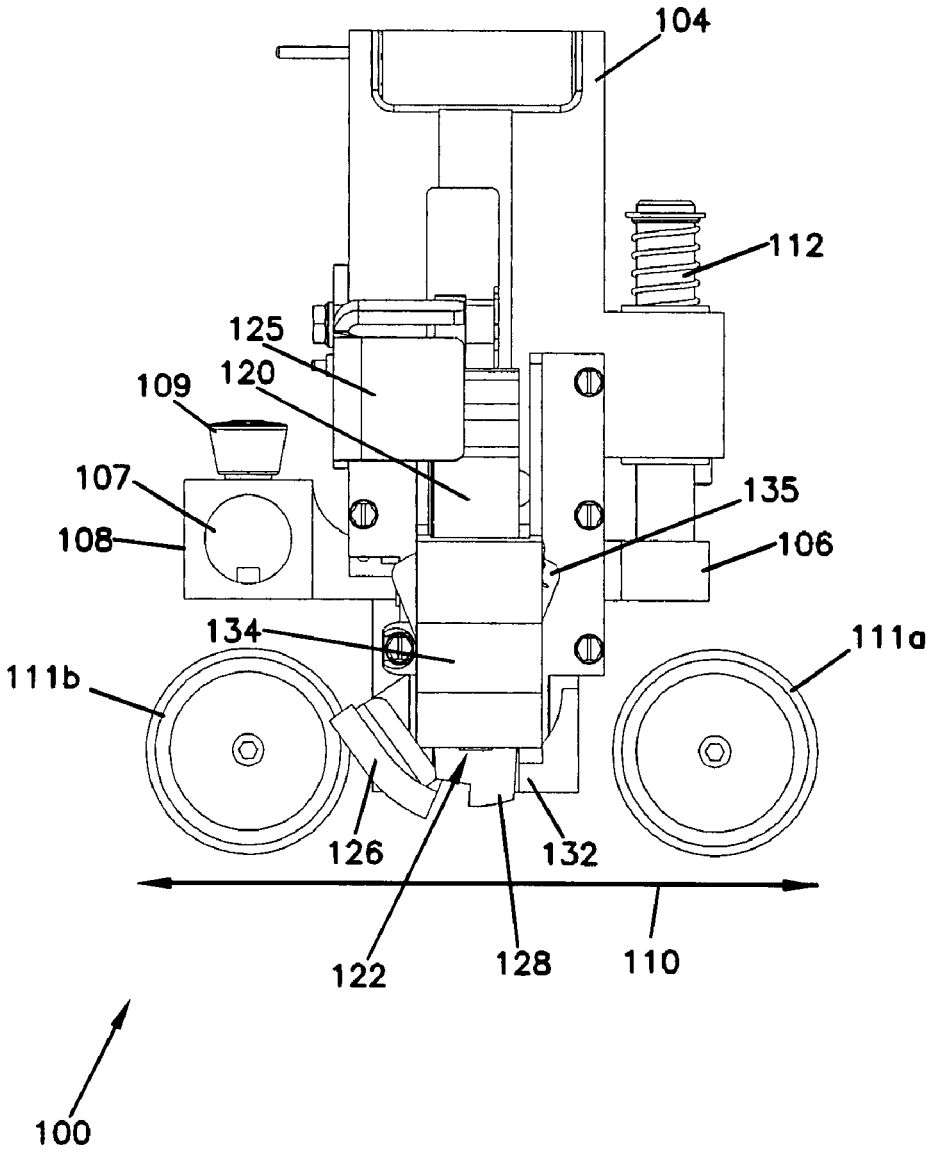
FIG. 6 is a top elevational view of the print assembly of FIG. 2 during a wiping process.
Figure 7:
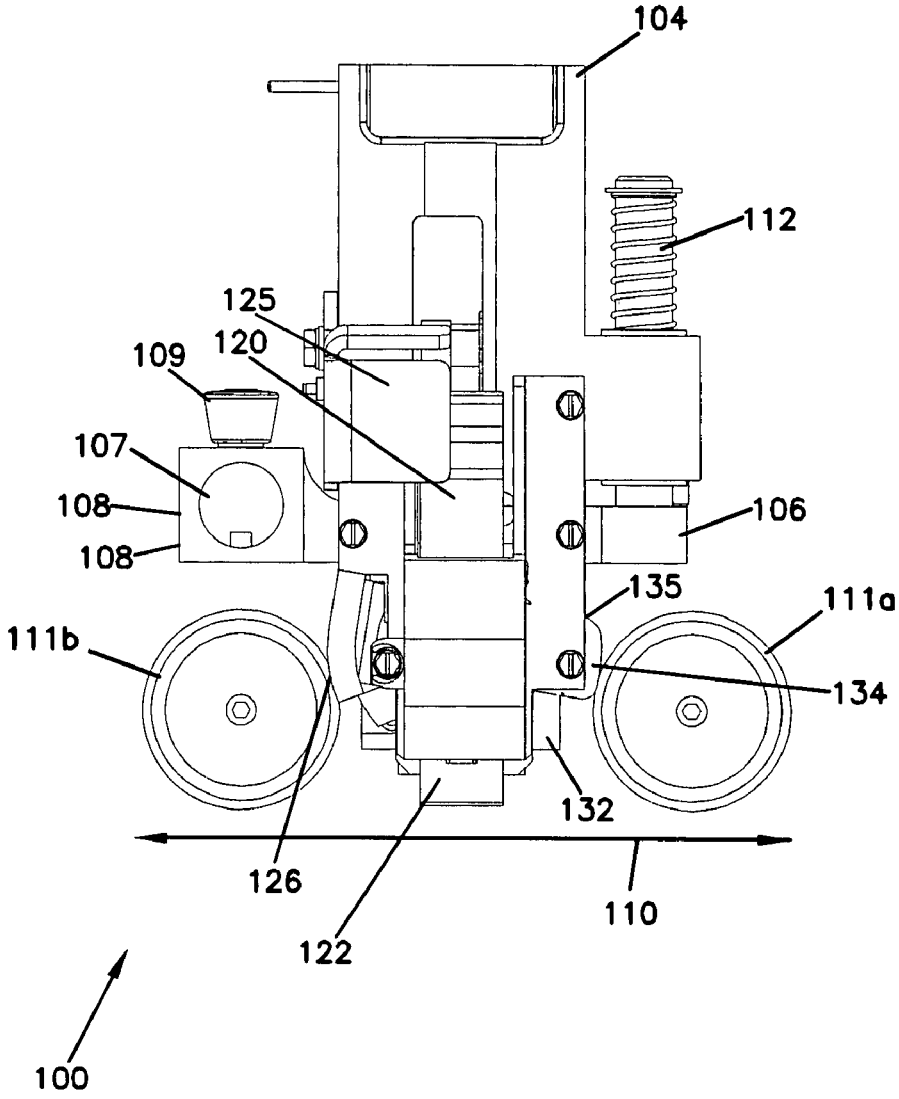
FIG. 7 is a top elevational view of the print assembly of FIG. 2 in a printing position.

Referring now to FIGS. 5-7, movement of the carriage 104 and clean and park assembly 126 are shown, in conjunction with the various positions of the cam plate 134 as driven by the motor 132. FIG. 5 illustrates the printing system 100 in a "parked" position. The system 100 generally resides in the parked position when not in operation, such as when power is shut off to the system. In this position, the clean and park assembly 126 covers the printing aperture 122. Specifically, the cap 130 of the clean and park assembly 126 aligns with the printing aperture 122 to cover and seal the printing aperture, preventing excess ink on the aperture from drying and blocking subsequent ink expelled from the cartridge 120 via the aperture. The compression springs 116 bias the carriage 104 toward the path of travel 110, causing the printing aperture 122 to be pressed into the cap 130, as previously mentioned. The cam plate 134 is rotated to a position in which it neither pivots the clean and park assembly 126 or presses the carriage 104 away from the path of travel 110.

FIG. 6 shows the system 100 at a midpoint during a wiping process. The wiping process generally occurs while the system 100 is moving between the parked position and the printing position in a clockwise direction, or vice versa. Example times a wiping process occurs include when the system 100 is turned on or off. During the wiping process, the wiper 128 of the clean and park assembly 126 slides across the printing aperture 122, cleaning excess ink off of the aperture 122. At the midpoint of the wiping process (as shown), the wiper 128 is approximately halfway across the aperture, and the cam plate 134 is rotated such that the notch 134 meets the roller 105 of the carriage 104. The carriage is allowed to move toward the path of travel 110 a distance equal to the depth of the notch 135. This allows the central portion of the aperture 122 to be cleaned, which may otherwise be left uncleaned due to the pivot arc followed by the wiper 130.

FIG. 7 shows the system 100 in a "printing" position. The system 100 enters the printing position (passing from the parked position through a wiping process) when powered on. In the printing position, the cam plate 134 has continued its clockwise rotation beyond the position of FIG. 6, such that it (1) allows the compression springs 116 to return the carriage to a position near the path of travel 110, and (2) pivots the clean and park assembly 126 away from the printing aperture 122. In the printing position, the printing aperture 122 is near the path of travel 110, defined by the two rollers 111*a-b*, allowing the system 100 to print on checks or other documents passing by the aperture.

Now referring to the printing system of FIGS. 2-7 generally, typical usage of the printing system 100 is described in conjunction with a printing process. When the system 100 is powered on during a printing operation, the carriage 104 is held in the printing position by compression springs 116, biasing the carriage 104 toward the frame 102 and thereby holding the printing aperture 122 near the path of travel 110 of documents, such as checks. A user can set the desired height at which the system 100 prints on documents by adjusting the height adjustment mechanism 108, by pulling the knob 109 to release the frame 102 such that it can slide along the pole 107 to a desired height. The user can direct the system 100 to print specific characters on the check, such as through use of an external computing system (not shown). The characters are printed on documents at a user-selected height defined by the height adjustment mechanism 108. During the printing process, the cam plate 134 is actuated by the motor 132 to maintain a constant position holding the clean and park assembly 126 pivoted away from the printing aperture 122 of the print cartridge 120. An example of this configuration, the "printing position" of the system, is described above in conjunction with FIG. 7.

When printing is completed, the motor 132 allows the cam plate 134 to rotate in a counterclockwise direction. As the cam plate 134 rotates, it allows the clean and park assembly 126, which is biased toward returning to the parked position, to pivot across the printing aperture 122, causing the wiper 130 to remove excess ink from the aperture (e.g. FIG. 6). The cam plate 134 disengages the roller 105, allowing the carriage 104 to be pressed by the compression springs 116 toward the path of travel 110, pressing the aperture 122 into the cap 130. An example of this configuration, an example of a "parked position" of the system, is described above in conjunction with FIG. 5.

In one embodiment, the motor 132 actuates, moving the cam plate 134 in the counterclockwise direction from the printing position to the parked position. In a second embodiment, the motor 132 is deactivated, allowing a spring biased clean and park assembly 126 or cam plate 134 to return to the parked position.

When the system 100 is reactivated to restart a printing process, the motor 132 activates, causing the cam plate 134 to rotate in a clockwise direction. The cam plate 134, as shown in the progression of FIGS. 5, 6, and 7, above, pivots the clean and park assembly 126 across the printing aperture 122, and engages the roller 105 to move the carriage 104 in a direction normal to the path of travel 110. This allows the clean and park assembly 126 to wipe the print aperture and align the cap 130 with the aperture.

Although the automated document processing system disclosed herein includes a printing system having the specific configuration disclosed in FIGS. 2-10, additional embodiments are encompassed by the present disclosure, including variants of the designs disclosed herein. Specifically, various other printing system configurations may be incorporated into the automated document processing system which could include varying mechanisms for cleaning and parking a printing assembly that is designed to remain stationary during a printing process.

The above specification, examples and data provide a complete description of the manufacture and use of the composition of the invention. Since many embodiments of the invention can be made without departing from the spirit and scope of the invention, the invention resides in the claims hereinafter appended.

The invention claimed is:

1. A printing system that secures a print cartridge, wherein the print cartridge includes a printing aperture that ejects ink from the print cartridge, comprising:
- a frame including a carriage mount;
- a carriage mounted to the carriage mount;
- a print cartridge housing connected to the carriage, wherein the print cartridge housing is configured to hold the print cartridge
- a clean and park station mounted to the frame; and
- a cam plate that drives both the print cartridge housing and the clean and park station between a printing position and a parked position.

2. The printing system of claim 1, further comprising
- a height adjustment mechanism, wherein the height-adjustment mechanism is connected to the carriage mount, wherein the height-adjustment mechanism includes
  - a pole extending through the frame, wherein the pole includes a plurality of spaced-apart openings, and
  - an adjustment knob connected to the frame and the pole, wherein the adjustment knob includes a spring-biased pin that extends through the frame and is selectively positionable within one opening of the plurality of spaced-apart openings of the pole.

3. The printing system of claim 2, wherein the spring-biased pin is:
- selectively-retractable from within the opening of the plurality of spaced-apart openings of the pole,
- selectively-movable relative to the pole, and
- selectively-locatable in another opening of the plurality of spaced-apart openings of the pole to provide
  - means for
    - selectively-moving the frame in a direction relative to the pole that is normal to a printable surface, and
    - selectively-fixing the frame in a different location relative to the pole from a previous selectively-fixed location relative to the pole in order to locate the print cartridge housing at a user-selected height of a plurality of user-selectable heights.

4. The printing system of claim 1, wherein the cam plate is coupled to both of the print cartridge housing and the clean and park station, wherein the cam plate is rotatably-driven by a mounting shaft to provide
- means for
  - retracting the print cartridge housing, and
  - pivoting the clean and park station.

5. The printing system of claim 4, wherein the mounting shaft is connected to a motor, wherein the motor is a stepper motor.

6. The printing system of claim 4, wherein, upon rotation of the cam plate by the mounting shaft in a first direction, the clean and park station is pivoted away from the printing aperture to arrange the clean and park station in the printing position.

7. The printing system of claim 6, wherein, upon rotation of the cam plate by the mounting shaft in a second direction opposite that of the first direction, the clean and park station is pivoted toward and covers the printing aperture to arrange the clean and park station in the parked position.

8. The printing system of claim 1, further comprising a spring mechanism coupled to the print cartridge housing, wherein the spring mechanism provides means for biasing the print cartridge housing toward a path of travel of a printable surface.

9. The printing system of claim 1, wherein the clean and park station includes a wiper, and a cap, wherein the wiper provides means for cleaning extraneous ink from the printing aperture to prevent streaking or smudging during a subsequent printing operation, wherein the cap provides means for sealing the printing aperture to prevent the extraneous ink from drying out in the printing aperture and causing printing failure.

10. The printing system of claim 1, further comprising a print distance adjustment mechanism connected to the carriage, wherein the print distance adjustment mechanism provides means for adjusting a distance between the printing aperture and a printable surface.

11. The printing system of claim 1, further comprising a print cartridge retention mechanism connected to the carriage, wherein the print cartridge retention mechanism includes a tab and a retention arm, wherein the print cartridge mechanism provides means for retaining the print cartridge within the print cartridge housing.

12. The printing system of claim 1, wherein the print cartridge is a disposable inkjet print cartridge.

13. A method comprising the steps of:

providing a printing system including: a frame including a carriage mount, a carriage mounted to the carriage mount, a print cartridge housing mounted to the carriage, a clean and park station mounted to the frame, and a cam plate coupled to both of the print cartridge housing and the clean and park station;

rotatably-driving the cam plate for retracting the print cartridge housing from a printing position, and pivoting the clean and park station to a parked position for wiping a printing aperture of a print cartridge and aligning a cap of the clean and park station with the printing aperture of the print cartridge.

14. The method of claim 13 further comprising the step of biasing the print cartridge housing toward a path of travel of a printable surface by a spring mechanism.

15. The method of claim 13, further comprising the step of when in the printing position, printing at least one character on a moving printable surface.

16. The method of claim 15, wherein the printable surface includes a surface of a check.

17. The method of claim 13, further comprising the step of adjusting a height of the print cartridge housing relative to a printable surface by adjusting a height adjustment mechanism.

18. A method of operating a printing system, the method comprising:

providing a print cartridge housing mounted to a carriage, the print cartridge housing configured to hold a print cartridge in a stationary printing position when printing onto a moving printable surface;

retracting a print cartridge housing from the printing position in a direction normal to a path of travel of a printable surface;

pivoting a clean and park station to a parked position across a printing aperture of a print cartridge held in the print cartridge housing to wipe the printing aperture and align a cap with the printing aperture; and rotating a cam plate configured to retract the print cartridge housing and pivot the clean and park station.

19. The method of claim 18, further comprising the steps of connecting the cam plate to a mounting shaft;

connecting the mounting shaft to a stepper motor; and actuating the stepper motor for rotating the mounting shaft for rotatably-driving the cam plate.

20. A printing system that secures a print cartridge, wherein the print cartridge includes a printing aperture that ejects ink from the print cartridge, comprising:

a frame including a carriage mount;

a carriage mounted to the carriage mount;

a print cartridge housing connected to the carriage, wherein the print cartridge housing is configured to hold the disposable inkjet print cartridge; a height adjustment mechanism connected to the carriage mount, wherein the height-adjustment mechanism includes a pole extending through the frame, wherein the pole includes a plurality of spaced-apart openings, and an adjustment knob connected to the frame and the pole, wherein the adjustment knob includes a spring-biased pin that extends through the frame and is selectively positionable within one opening of the plurality of spaced-apart openings of the pole; and a clean and park station mounted to the frame.

21. The printing system of claim 20 further comprising a motor coupled to the print cartridge housing and the clean and park station that provides means for driving the print cartridge housing and the clean and park station between a printing position and a parked position, wherein, in the parked position, the clean and park station wipes and covers a printing aperture of a print cartridge.

22. The printing system of claim 20, further comprising a print cartridge retention mechanism connected to the carriage, wherein the print cartridge retention mechanism includes a tab and a retention arm, wherein the print cartridge mechanism provides means for retaining the print cartridge within the print cartridge housing.

23. A printing system comprising:

a carriage mountable adjacent to a path of travel of a check;

a print cartridge housing configured to hold a disposable inkjet print cartridge having a printing aperture oriented toward the path of travel of the check, the print cartridge housing mounted to a chassis and moveable in a direction normal to the path of travel of the printable surface;

a height adjustment mechanism configured to locate the print cartridge housing at a plurality of user-selectable heights along the path of travel;

a clean and park station including a wiper and a cap, the clean and park station pivotally mounted to the chassis and capable of pivoting across the printing aperture of the disposable inkjet print cartridge to wipe and cover the printing aperture;

a motor configured to drive the print cartridge housing and the clean and park station between a printing position and a parked position; and a cam plate shaped and located to drive both the print cartridge housing and the clean and park station between a printing position and a parked position.

* * * * *